US009523141B2

(12) United States Patent
Washio et al.

(10) Patent No.: US 9,523,141 B2
(45) Date of Patent: Dec. 20, 2016

(54) HIGH STRENGTH MG ALLOY AND METHOD FOR PRODUCING SAME

(71) Applicants: Kota Washio, Shizuoka (JP); Akira Kato, Mishima (JP); Toshiji Mukai, Kobe (JP); Alok Singh, Tsukuba (JP); Hidetoshi Somekawa, Tsukuba (JP)

(72) Inventors: Kota Washio, Shizuoka (JP); Akira Kato, Mishima (JP); Toshiji Mukai, Kobe (JP); Alok Singh, Tsukuba (JP); Hidetoshi Somekawa, Tsukuba (JP)

(73) Assignees: TOYOTA JIDOSHA KABUSHIKI KAISHA, Toyota (JP); NATIONAL UNIVERSITY CORPORATION KOBE UNIVERSITY, Kobe-shi (JP); NATIONAL INSTITUTE FOR MATERIALS SCIENCE, Tsukuba-shi (JP)

( * ) Notice: Subject to any disclaimer, the term of this patent is extended or adjusted under 35 U.S.C. 154(b) by 330 days.

(21) Appl. No.: 14/356,502

(22) PCT Filed: Nov. 6, 2012

(86) PCT No.: PCT/JP2012/078734
§ 371 (c)(1),
(2) Date: May 6, 2014

(87) PCT Pub. No.: WO2013/069638
PCT Pub. Date: May 16, 2013

(65) Prior Publication Data

US 2015/0047756 A1 Feb. 19, 2015

(30) Foreign Application Priority Data

Nov. 7, 2011 (JP) ..... 2011-243183

(51) Int. Cl.
*C22C 23/04* (2006.01)
*C22F 1/06* (2006.01)
(Continued)

(52) U.S. Cl.
CPC . *C22F 1/06* (2013.01); *C22C 1/02* (2013.01); *C22C 23/00* (2013.01); *C22C 23/04* (2013.01); *C22F 1/00* (2013.01)

(58) Field of Classification Search
CPC ..... C22F 1/06; C22F 1/00; C22C 1/02; C22C 23/00; C22C 23/04
See application file for complete search history.

(56) References Cited

U.S. PATENT DOCUMENTS

2008/0017285 A1* 1/2008 Mukai ..... C22C 23/00 148/667
2013/0209195 A1 8/2013 Kuwabara et al.

FOREIGN PATENT DOCUMENTS

JP 7-18364 1/1995
JP 7-18364 A * 1/1995
(Continued)

OTHER PUBLICATIONS

Larionova et al., "A Ternary Phase Observed in Rapidly Solidified Mg—Ca—Zn Alloys," Scripta Materialia, vol. 45, pp. 7-12, 2001.
(Continued)

*Primary Examiner* — Colleen Dunn
(74) *Attorney, Agent, or Firm* — Oliff PLC

(57) ABSTRACT

Provided is an Mg alloy and a method for producing same able to demonstrate high strength without requiring an expensive rare earth element (RE). The high-strength Mg alloy containing Ca and Zn within a solid solubility limit and the remainder having a chemical composition comprising Mg and unavoidable impurities is characterized in comprising equiaxial crystal particles, there being a segregated area
(Continued)

of Ca and Zn along the (c) axis of a Mg hexagonal lattice within the crystal particle, and having a structure in which the segregated area is lined up by $Mg_3$ atomic spacing in the (a) axis of the Mg hexagonal lattice. The method for producing the high-strength Mg alloy is characterized in that Ca and Zn are added to Mg in a compounding amount corresponding to the above composition and, after homogenization heat treating an ingot formed by dissolution and casting, the above structure is formed by subjecting the ingot to hot processing.

3 Claims, 5 Drawing Sheets

(51) Int. Cl.

| | |
|---|---|
| ***C22C 1/02*** | (2006.01) |
| ***C22C 23/00*** | (2006.01) |
| *C22F 1/00* | (2006.01) |

(56) References Cited

FOREIGN PATENT DOCUMENTS

| | | | |
|---|---|---|---|
| JP | 9-41065 | | 2/1997 |
| JP | 2009-79271 | | 4/2009 |
| JP | 2009-84685 | | 4/2009 |
| JP | 2009-221579 | | 10/2009 |
| JP | 2012-082474 | A | 4/2012 |
| WO | WO 2006/004072 | | 1/2006 |
| WO | WO 2006/004072 | A2 * | 1/2006 |
| WO | WO 2012/049990 | | 4/2012 |

OTHER PUBLICATIONS

Tainaka, Y. et al., "Superplasticity of Ultrafine Crystal Grain Mg—Zn—Ca Alloy", Collected Abstracts of the 2011 Autumn (149th) Meeting of the Japan Institute of Metals, Poster session, p. 405, (Oct. 20, 2011).

* cited by examiner (a)

(b)

(a)

(b)

HIGH STRENGTH MG ALLOY AND METHOD FOR PRODUCING SAME

TECHNICAL FIELD

The present invention relates to a high strength Mg alloy and a method of producing the same.

BACKGROUND ART

Mg alloys have attracted attention as structural materials, due to their light weight, thereby having a high specific strength.

Patent Document 1 proposed a high strength Mg—Zn-RE alloy which comprises Zn and a rare earth element (RE: one or more of Gd, Tb, and Tm), as well as Mg and unavoidable impurities as the balance, and which has a long period stacking ordered structure (LPSO).

However, the above proposed alloy has a problem in that it requires a rare earth element RE as an essential element, and therefore is expensive as a structural material.

For this reason, development of an Mg alloy which exhibits high strength without requiring an expensive rare earth element RE has been desired.

RELATED ART

Patent Document 1: Japanese Laid-open Patent Publication No 2009-221579

SUMMARY OF INVENTION

Problems to be Solved by the Invention

The object of the present invention is to provide a Mg alloy capable of exhibiting high strength without requiring use of an expensive rare earth element RE and a method of producing the same.

Means to Solve the Problems

To achieve the above object, according to the present invention, there is provided a high strength Mg alloy characterized by having a chemical composition which contains Ca and Zn within a solid solubility limit, and the balance comprised of Mg and unavoidable impurities, and having a structure comprising equiaxial crystal grains and having segregated regions of Ca and Zn along the c-axis direction of the Mg hexagonal lattice in the crystal grains, wherein the segregated regions are arranged at intervals of three Mg atoms in the a-axis direction of the Mg hexagonal lattice.

According to the present invention, there is further provided a method of producing the high strength Mg alloy, characterized by adding Ca and Zn to Mg in amounts which correspond to the above composition, melting and casting them to form an ingot, subjecting the ingot to a homogenizing heat treatment, and subsequently subjecting the ingot to hot working to generate the above structure.

Effects of the Invention

According to the present invention, it is possible to achieve equivalent high strength without requiring an expensive rare earth element RE by having a structure comprising equiaxial crystal grains and having segregated regions of Ca and Zn along the c-axis direction of the Mg hexagonal lattice in the crystal grains, wherein the segregated regions are arranged at intervals of three Mg atoms in the a-axis direction of the Mg hexagonal lattice.

MODE FOR CARRYING OUT THE INVENTION

The alloy of the present invention has a chemical composition which contains Ca and Zn within a solid solubility limit, and the balance comprised of Mg and unavoidable impurities. Due to this, a state wherein Ca and Zn are solid-solubilized in Mg is obtained. Due to the solid-solubilized state, intermetallic compounds (ordered phase) and coarse precipitates are not formed, and therefore reduction in ductility caused thereby will not occur.

The solid solubility limit for the Mg—Ca—Zn ternary system is not precisely known, but in the Mg—Ca binary system phase diagram (Mg solid solubility range limit at 515° C.), the solid solubility limit of Ca in Mg is 0.5 at %, and in the Mg—Zn binary system phase diagram (Mg solid solubility range limit at 343° C.), the solid solubility limit of Zn in Mg is 3.5 at %. Using these known facts as a rough measure, in the alloy of the present invention, to secure the solid-solubilized state, the content of Ca may be 0.5 at % or less and the content of Zn may be 3.5 at % or less.

The alloy of the present invention is characterized by having a structure comprising equiaxial crystal grains and having segregated regions of Ca and Zn along the c-axis direction of the Mg hexagonal lattice in the crystal grains, wherein the segregated regions are arranged at intervals of three Mg atoms in the a-axis direction of the Mg hexagonal lattice.

The fact that the structure is comprised of fine equiaxial crystal grains prevents the deformation twin from occurring, which makes it possible to improve the deformation behavior, in particular yield stress, upon compression, and therefore ensures good formability required for structural materials. In particular, the crystal grain size is preferably less than 1 μm, that is, several hundred nm or less.

Figure 1:
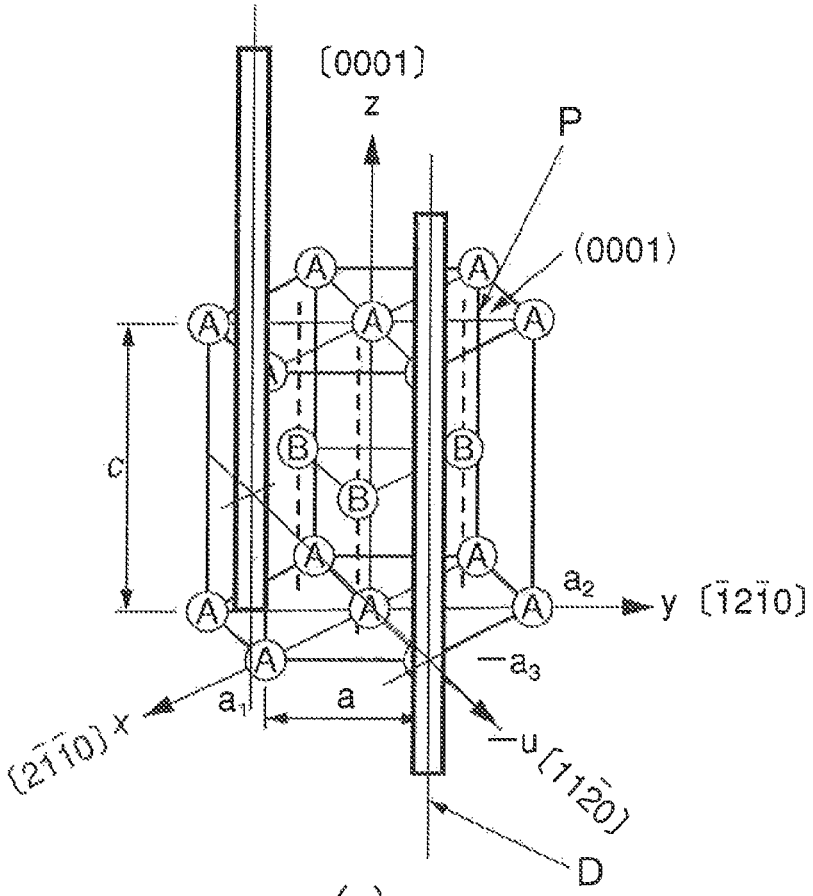
FIG. 1 is a schematic view which shows the structures and strengthening mechanisms of the present invention and the prior art in comparison with each other.
Figure 1:
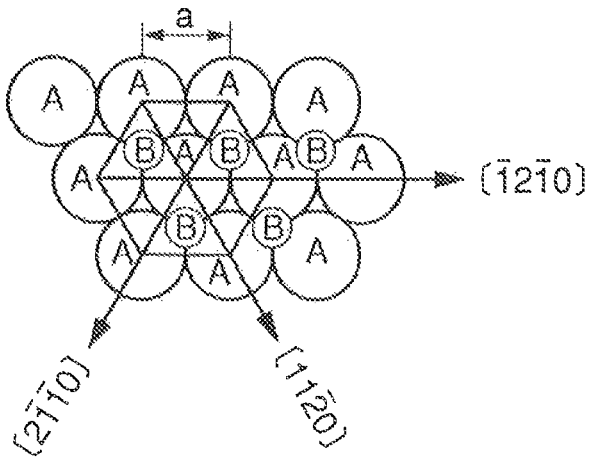

Further, the alloy of the present invention is characterized by its structure at the electron microscope level. That is, there are segregated regions of Ca and Zn along the c-axis direction of the Mg hexagonal lattice in the crystal grains, and the segregates regions form a periodic structure in which the segregated regions are arranged at intervals of three Mg atoms in the a-axis [11-20] direction of the Mg hexagonal lattice, as will be explained in detail in the examples. Linear segregated regions D are schematically shown in FIG. 1. Since the presence of linear segregated regions D along the c-axis direction produces a strain in the Mg lattice, the segregated regions act as a barrier to the movement of dislocations on the basel plane (0001), and thus a high strength can be achieved. To obtain the structure of the present invention, it is necessary to perform casting, solubilizing (homogenizing) heat treatment, and subsequent hot working. Due to this, it is possible to realize high strength without using an expensive rare earth element RE.

To achieve the above periodic structure, it is preferable that the atomic ratio of the Ca and Zn contents, Ca:Zn, is within the range of 1:2 to 1:3.

As opposed to this, in the prior art according to Patent Document 1, strain is produced by segregating Zn and the rare earth element RE planarly on the basal plane P of the Mg hexagonal lattice shown in FIG. 1, to strengthening the Mg lattice. Planar segregated layers P are stacked at intervals of several layers of Mg atoms (for example, by three to six atoms) in the c-axis [0001] direction to form a long period stacking ordered structure (LPSO). Due to this, strength of about 300 to 400 MPa is achieved. This structure is formed by casting, solubilizing (homogenizing) heat treatment, and subsequent heat treatment under specific conditions. Hot working as carried out in the present invention is not performed. However, to realize this strengthening mechanism, the presence of an expensive rare earth element RE is essential, and an increase in material cost is unavoidable.

The present invention will be illustrated in detail by means of the Examples below.

EXAMPLES

Mg alloys of the present invention were prepared by the following procedures and conditions.

<Smelting and Casting of Alloys)

The Mg—Ca—Zn alloys of each composition shown in Table 1 were smelted.

The ingredients were mixed in accordance with the compositions of Table 1 and smelted in a mixed atmosphere of carbon dioxide and a combustion preventive gas.

Gravity casting was used to cast ϕ90 mm×100 mmL ingots.

<Homogenizing Heat Treatment>

The ingots produced as described above were subjected to heat treatment in a carbon dioxide atmosphere a 480 to 520° C.×24 hrs to homogenize (solubilize) them.

<Hot Working>

The ingots were hot extruded in one stage or two stages at the temperatures and extrusion ratios shown in Table 1.

<Evaluation>

<<Mechanical Properties>>

Tensile test was performed in a direction parallel to the extrusion direction. The elongation at break, 0.2% yield strength, and 0.2% specific strength are shown in Table 1. As a whole, in accordance with the extrusion temperature and extrusion ratio, a high strength represented by 0.2% yield strength of 280 to 482 MPa and 0.2% specific strength of 150 to 275 kNm/kg as well as a good elongation at break of 6% to 23% were obtained.

Figure 2:
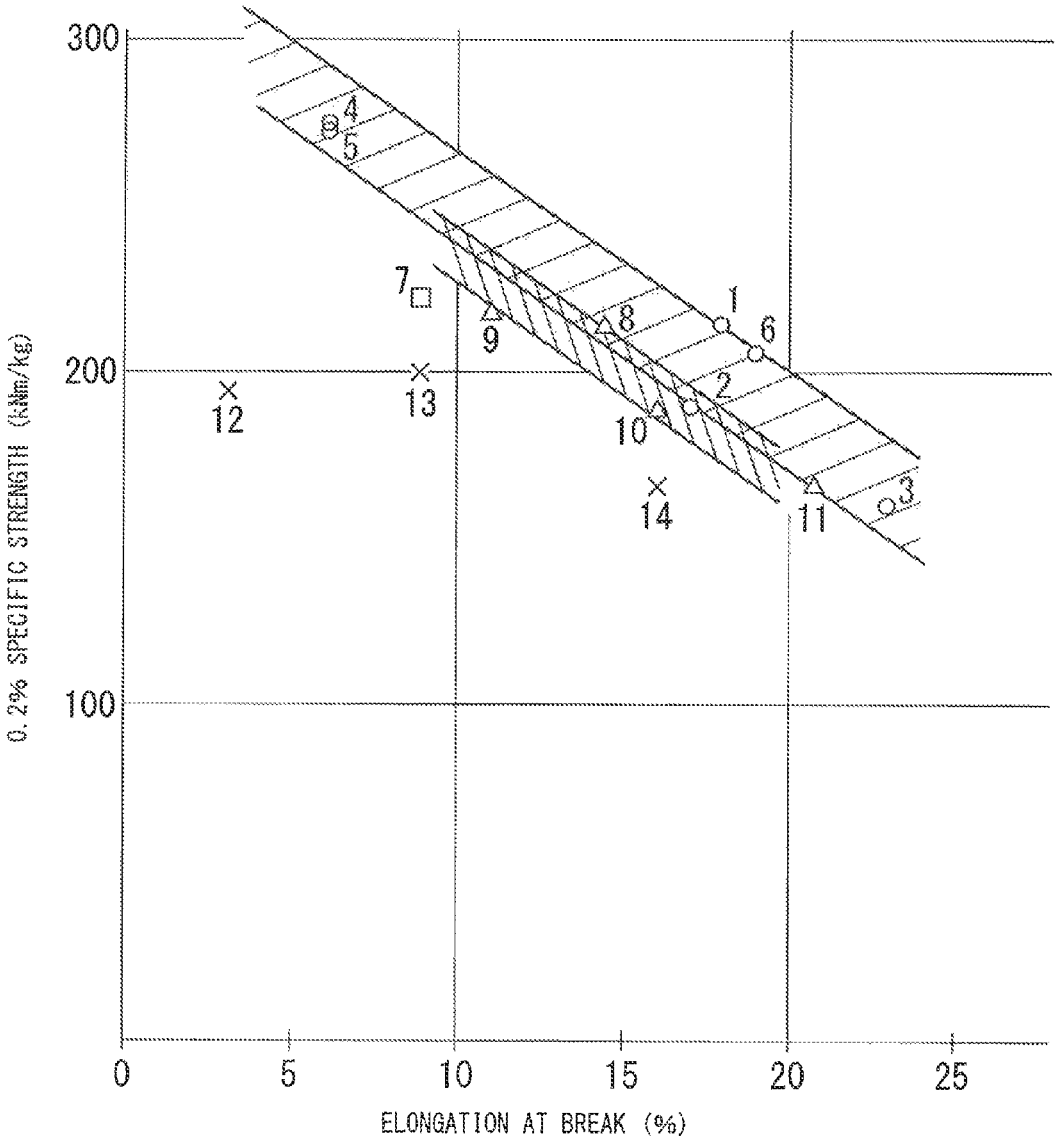
FIG. 2 is a graph which shows the relationship between the elongation at break and the specific strength in the examples of the present invention.

FIG. 2 shows the plots for the 0.2% specific strength against the elongation at break of the horizontal axis for all

TABLE 1

| | | Alloying conditions | | | | | Strong strain working conditions | | | | |
|---|---|---|---|---|---|---|---|---|---|---|---|
| | | Added elements | | | Homogenizing heat treatment | | First extrusion | | Second extrusion | | Total |
| Sample no. | Sample name | Ca (at %) | Zn (at %) | Ca:Zn | Temp. (° C.) | Time (h) | Temp. (° C.) | Extrusion ratio | Temp. (° C.) | Extrusion ratio | extrusion ratio |
| 1 | 0309CZ-1 | 0.3 | 0.9 | 1:3 | 480 | 24 | 350 | 5:1 | 238 | 25:1 | 125:1 |
| 2 | 0309CZ-2 | 0.3 | 0.9 | 1:3 | 480 | 24 | 350 | 5:1 | 265 | 25:1 | 125:1 |
| 3 | 0309CZ-3 | 0.3 | 0.9 | 1:3 | 480 | 24 | 350 | 5:1 | 298 | 25:1 | 125:1 |
| 4 | 0306CZ-1 | 0.3 | 0.6 | 1:2 | 520 | 24 | 346 | 11:1 | 236 | 25:1 | 396:1 |
| 5 | 0306CZ-2 | 0.3 | 0.6 | 1:2 | 520 | 24 | 346 | 11:1 | 243 | 25:1 | 396:1 |
| 6 | 0306CZ-3 | 0.3 | 0.6 | 1:2 | 520 | 24 | 346 | 11:1 | 305 | 25:1 | 396:1 |
| 7 | 01503CZ | 0.15 | 0.3 | 1:2 | 500 | 24 | 377 | 5:1 | 245 | 25:1 | 125:1 |
| 8 | 0303CZ | 0.3 | 0.3 | 1:1 | 500 | 24 | 383 | 5:1 | 240 | 25:1 | 125:1 |
| 9 | 03045CZ | 0.3 | 0.45 | 1:1.5 | 500 | 24 | 376 | 5:1 | 245 | 25:1 | 125:1 |
| 10 | 0312CZ | 0.3 | 1.2 | 1:4 | 500 | 24 | 331 | 5:1 | 240 | 25:1 | 125:1 |
| 11 | 0315CZ | 0.3 | 1.5 | 1:5 | 500 | 24 | 337 | 5:1 | 231 | 25:1 | 125:1 |
| 12 | 0303CZ | 0.3 | 0.3 | 1:1 | 500 | 24 | 281 | 18:1 | — | | 18:1 |
| 13 | 0309CZ | 0.3 | 0.9 | 1:3 | 500 | 24 | 270 | 18:1 | — | | 18:1 |
| 14 | 0318CZ | 0.3 | 1.8 | 1:6 | 500 | 24 | 236 | 18:1 | — | | 18:1 |

| | Alloy characteristics Mechanical properties | | | Crystal structure | |
|---|---|---|---|---|---|
| Sample no. | Elongation at break (%) | 0.2% yield strength (MPa) | 0.2% specific strength (kNm/kg) | Presence of periodic structure | Average crystal grain size (nm) |
| 1 | 18 | 375 | 214 | Yes | 300 |
| 2 | 17 | 330 | 189 | Yes | |
| 3 | 23 | 280 | 160 | Yes | 1000 |
| 4 | 6 | 482 | 275 | Yes | 300 |
| 5 | 6 | 477 | 273 | Yes | 400 |
| 6 | 19 | 360 | 206 | Yes | |
| 7 | 8.8 | 391 | 223 | Yes | |
| 8 | 14.4 | 374 | 214 | None | |
| 9 | 11 | 382 | 218 | None | |
| 10 | 16.1 | 330 | 189 | None | |
| 11 | 20.8 | 291 | 166 | None | |
| 12 | 3 | 338 | 193 | None | 500 |
| 13 | 8.9 | 350 | 200 | None | 500 |
| 14 | 15:8 | 291 | 166 | None | 500 |

of Sample Nos. 1 to 14 in Table 1. The present invention is characterized by the improvement in strength at the same ductility.

Sample Nos. 1 to 6 achieved the highest specific strengths against the elongation at break of the horizontal axis in FIG. 2. The ○ (circle) plots of these samples are in the broken line region which is shown at the top of this figure. Sample Nos. 1 to 6 have Ca and Zn contents in the preferred ranges of Ca≤0.5 at % and Zn≤3.5 at % in the present invention, an atomic ratio of the Ca and Zn contents, Ca:Zn within the range of 1:2 to 1:3, and a first extrusion temperature of 300° C. or more which is within the preferred range for the hot working temperature in the present invention. As a result, the periodic structure of the present invention was obtained, and a combination of excellent ductility and strength was obtained.

As with Sample Nos. 1 to 6, Sample No. 7 had Ca and Zn contents and a ratio of the Ca and Zn contents, as well as a first extrusion temperature within the preferred range in the present invention. However, since the Ca content was 0.15 at % which is lower than 0.3 at % for Sample Nos. 1 to 6, the resulting specific strength is lower than those of Sample Nos. 1 to 6, as indicated by the □ (square) plot in FIG. 2. A periodic structure was obtained in the crystal structure. Since the strength fluctuates with the contents of the alloy elements Ca and Zn as described above, strictly speaking, the combinations of ductility and strength need to be compared with each other at the same contents of the alloy elements. All of the samples other than Sample No. 7 had the same Ca content of 0.3 at %.

Sample Nos. 8 to 11 had a content ratio Ca:Zn which is outside the preferred range of 1:2 to 1:3 in the present invention. As indicated by the Δ (triangle) plots in FIG. 2, these samples are positioned in the region of lower strength than the region of the ○ plots of Sample Nos. 1 to 6. Any periodic structure was not confirmed in the crystal structures.

Sample Nos. 12 to 14, unlike the other samples, were hot worked by extrusion at a temperature of less than 300° C. just once. As indicated by the X (cross) plots in FIG. 2, these samples are at the lowest position. Compared with the preferred embodiment of the present invention, the Ca:Zn ratio was outside the range (Sample Nos. 12 and 14), the hot working (extrusion) temperature was less than 300° C. (Sample Nos. 12, 13, and 14), and the crystal structure had no periodic structure (Sample Nos. 12, 13, and 14).

<<Structure Observation>>

The average crystal grain sizes and the presence or absence of a periodic structure, as determined by structure observation with a transmission electron microscope (TEM) are shown in Table 1. In the case of Sample name 0309CZ-1 (composition: Mg-0.3 at % Ca-0.9 at % Zn, second extrusion temperature: 238° C.) and Sample name 0306CZ-1 (composition: Mg-0.3 at % Ca-0.6 at % Zn, second extrusion temperature: 236° C.), a clear periodic structure was observed.

Figure 3:
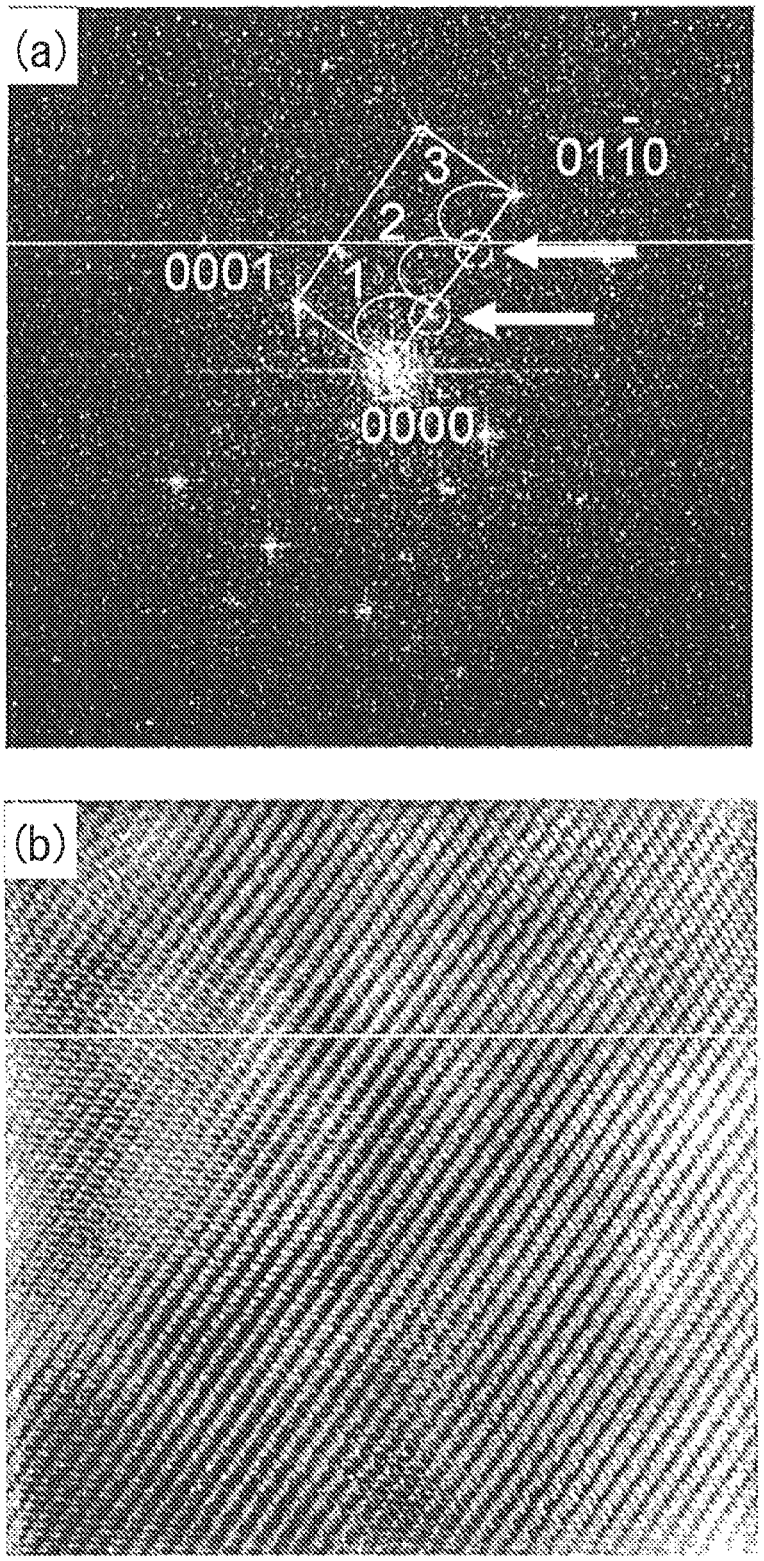
FIG. 3 shows the electron microscope observation results of the periodic structure of the present invention.

FIG. 3 shows, as a typical example of electron microscope observation, (a) a Fourier transform diagram (corresponding to an electron beam diffraction image) of the lattice image and (b) the lattice image for Sample name 0309CZ-1.

As shown by the Fourier transform diagram of FIG. 3(*a*), two diffraction spots are perceived between the diffraction spot of the [01-10] plane and (0000). These two diffraction spots are do not appear in the case of pure Mg, showing that the alloy of the present invention has a 3X "superlattice" in the direction of the (0110) plane. The term "superlattice" means a crystal lattice having a periodic structure which is longer than the basic unit lattice due to the superposition of a plurality of types of crystal lattices. As described in Table 1, Sample name 0306CZ-1 also exhibits a structure having a similar periodic structure. Therefore, among the samples prepared in the Examples, it can be said that two examples of Sample name 0309CZ-1 and Sample name 0306CZ-1 are alloys which satisfy the requirements of the present invention. These two samples both had an average crystal grain size of 300 nm, and the crystal grains were equiaxial. Further, for the mechanical properties, Sample name 0309CZ-1 had a specific strength of 375 kNm/kg and an elongation at break of 18%, and Sample name 0306CZ-1 had a specific strength of 482 kNm/kg and an elongation at break of 6%, as shown in Table 1.

The Examples show that the formation of the periodic structure depends on the second extrusion temperature in each composition. Of course, in general, the presence or absence of the periodic structure is determined in accordance with the combination of the second extrusion temperature and other hot working conditions such as the first extrusion conditions. It is possible to set the hot working conditions suitable for forming a periodic structure in accordance with the composition by preliminary experiments. The preliminary experiments can be easily performed by a person skilled in the art, by use of well-known techniques.

The above periodic structure due to the superlattice is the most important characteristic of the alloy of the present invention. That is, as shown in FIG. 1, the segregated regions D of Ca and Zn extend linearly in the c-axis direction.

Figure 4:
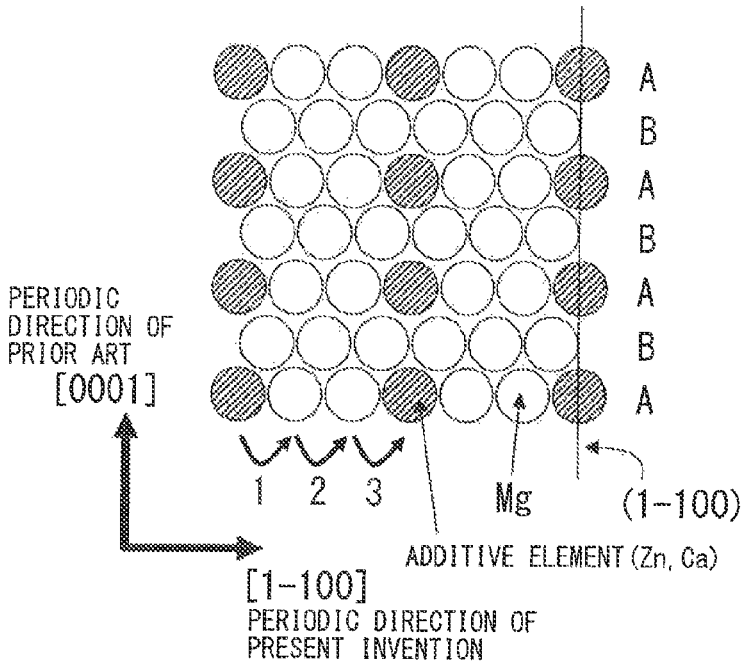
FIG. 4 is a schematic view of the periodic structure of the present invention when seen from the a-axis direction.
Figure 4:
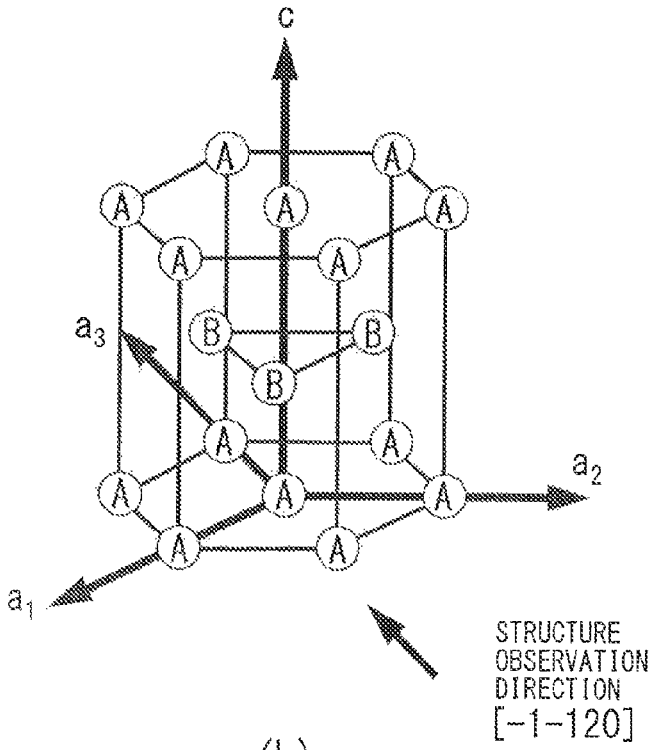

FIG. 4 (*a*) shows the periodic structure of the present invention observed from the a-axis [−1-120] direction shown in FIG. 4(*b*), The segregated regions ID of Ca and Zn are present at intervals of three atomic planes in the a-axis [1-100] direction. This corresponds to two diffraction spots between the diffraction spot on the [01-10] plane and (0000) shown in FIG. 3(*a*). The LPSO (long period stacking order) structure of the prior art completely differs from that of the present invention in that there is a periodic stacking structure along the c-axis [0001] direction as shown in FIG. 4 (*a*).

Figure 5:
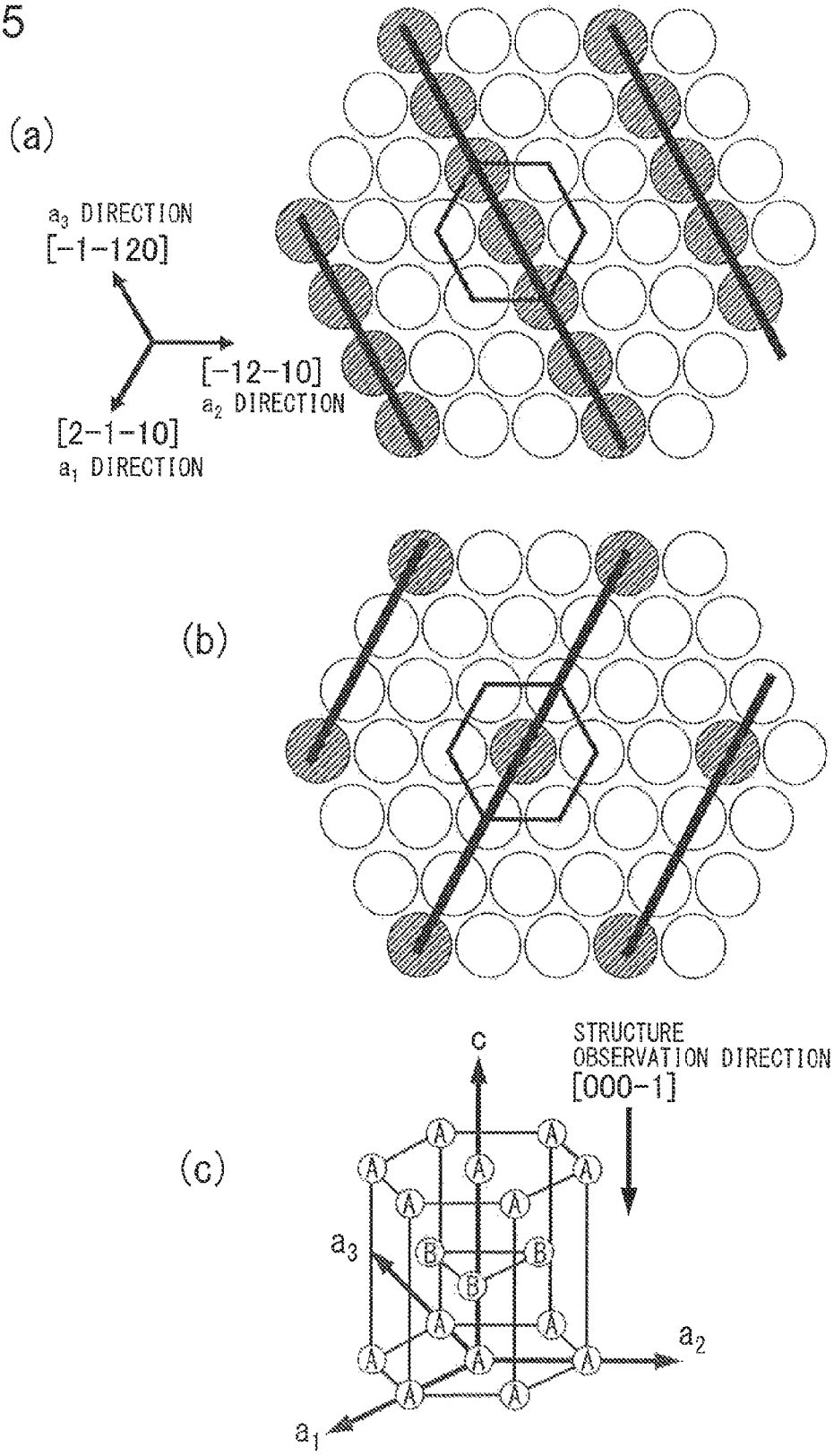
FIG. 5 is a schematic view of the periodic structure of the present invention when seen from the c-axis direction.

FIG. 3 and FIG. 4 show the state observed from the a-axis [−1-20] direction. FIG. 5 shows the state when the same crystal lattice was observed from the c-axis [000-1] direction (FIG. 5(*c*)). Even if seen in the same way from the a-axis, two typical cases may be envisioned: a case having a periodic nature in only one direction as shown in FIG. 5(*a*) and a case having a periodic nature in all three directions as shown in FIG. 5(*b*). Since the added amounts of the segregating elements Ca and Zn are slight in the alloy of the present invention, it is though that the alloy may have a periodic structure which has a periodicity in each of three directions as shown in FIG. 5(*b*).

INDUSTRIAL APPLICABILITY

According to the present invention, there are provided a Mg alloy capable of exhibiting a high strength without requiring an expensive rare earth element RE, and a method of producing the same.

The invention claimed is:

1. A high strength Mg alloy characterized by having a chemical composition which contains Ca in an amount of from 0.15 to 0.3 at % and Zn in an amount of 0.6 at % or less, and the balance comprised of Mg and unavoidable impurities, and having a structure comprising equiaxial crystal grains and having segregated regions of Ca and Zn along the c-axis direction of the Mg hexagonal lattice in the crystal grains, wherein the segregated regions are arranged at intervals of three Mg atoms in the a-axis direction of the Mg hexagonal lattice, wherein the contents of Ca and Zn are in the relation of Ca:Zn=1.2 at atomic ratio.

2. A method of producing a high strength Mg alloy according to claim 1, characterized by adding Ca and Zn to Mg in amounts which correspond to the above composition, melting and casting them to form an ingot, subjecting the ingot to a homogenizing heat treatment, and subsequently subjecting the ingot to hot working to generate the structure as defined in claim 1.

3. The method of producing a high strength Mg alloy according to claim 2 characterized by performing the hot working at least one time at a temperature of 300° C. or more.

* * * * *